US006036394A

United States Patent [19]

Cheng

[11] Patent Number: 6,036,394

[45] Date of Patent: Mar. 14, 2000

[54] RING METALS WITH LINKAGE LOCKING DEVICE

[75] Inventor: Ho Ping Cheng, New Territories, The Hong Kong Special Administrative Region of the People's Republic of China

[73] Assignee: World Wide Stationary Manufacturing Co., Ltd., Kwai Chung, The Hong Kong Special Administrative Region of the People's Republic of China

[21] Appl. No.: 09/201,117

[22] Filed: Nov. 30, 1998

[51] Int. Cl.[7] ..... B42F 13/00

[52] U.S. Cl. ..... 402/26; 402/31; 402/36; 402/41; 402/38

[58] Field of Search ..... 402/26, 31, 36–42

[56] References Cited

U.S. PATENT DOCUMENTS

| | | | |
|---|---|---|---|
| 798,854 | 9/1905 | Wendland | 402/31 |
| 1,720,242 | 7/1929 | Schade | 402/26 |
| 2,024,461 | 12/1935 | Lotter | 402/26 |
| 2,928,398 | 3/1960 | Rankin | 402/31 |
| 3,717,416 | 2/1973 | Schade | 402/31 |
| 3,718,402 | 2/1973 | Schade | 402/31 |
| 4,130,368 | 12/1978 | Jacoby et al. | 402/41 |
| 4,168,920 | 9/1979 | Ohminato | 402/46 |
| 4,815,882 | 3/1989 | Ohminato | 402/34 |
| 4,919,557 | 4/1990 | Podosek | 402/36 |
| 5,660,490 | 9/1997 | Warrington | 402/36 |
| 5,810,499 | 9/1998 | Law | 402/26 |
| 5,836,709 | 11/1998 | Cheung | 402/38 |

*Primary Examiner*—Willmon Fridie, Jr.
*Assistant Examiner*—Alisa Thurston
*Attorney, Agent, or Firm*—Skjvern, Morrill, MacPherson, Franklin & Friel LLP; David E. Steuber

[57] ABSTRACT

A ring binder is provided including a linearly-extending first spine, a linearly-extending second spine, a series of spaced first substantially half-rings attached to one of the spines, and a series of spaced second substantially half-rings on the other of the spines, the distal ends of the half-rings on the first spine facing the distal end of the half-rings on the second spine. A hinge connection extends between the spines. A releasable lock includes a lever and a pair of links is pivoted to the lever and to outer edges of the spines. An integral lever tab extends from between the ends of the spines. Push movement inwardly of the lever, by pushing the lever tabs, places the lock into a locking mode holding the first and second half-rings closed in a paper sheets-holding mode. An outward pull movement of the lever tab places the lock into a non-locking mode resulting in opening of the first and second half-rings in a paper sheets removal mode. A pair of coil springs may be associated with a hinge pintle and the spines to assist in moving the rings to an open position.

17 Claims, 10 Drawing Sheets

RING METALS WITH LINKAGE LOCKING DEVICE

RELATED APPLICATION

This application is a further embodiment and improvement of the invention described in U.S. Ser. No. 09/179,380, filed Oct. 26, 1998, assigned to a common assignee.

BACKGROUND OF THE INVENTION

The present invention relates to a ring binder for holding a number of punched holed paper sheets, more particularly to a mechanism for locking and unlocking the rings or paper-holding elements of the binder.

Previously ring binders have taken many forms. Typically a fixed one-piece notched spine is provided where the inboard ends of facing rings are connected by an actuating mechanism to finger triggers at opposite ends of the spine which, when pressed, open the facing rings. The binder, after addition or removal of punched-hole paper sheets to or from the rings, is closed by pushing the rings together in a snap-motion. Each of these closing and opening operations take considerable effort and manual finger manipulation, particular when a large number of sheets are in the binder. The rings of prior art binders are normally attached to the actuation mechanism and the trigger linkage is interiorly of the spine. The single spine itself is normally rivet-connected to a portion of the binder cover. The ring binders of the prior art generally use rings or levers to open and close the rings without a positive locking function. Thus, a need has existed to have a ring binder which is easily closed with a minimum of effort, more particularly by only a slight pressure on only one of the ring elements. Likewise a need has existed to provide a ring binder which has a positive ring lock while providing for a slight pressure at one end of the spine to easily effect the opening of the rings.

In the related application, a hinged two-piece spine is provided along with a bridge member therebetween. Locks are provided in the form of a pivotable hook member and pivot link at each end of the spines for locking the spines at a predetermined angle.

BRIEF SUMMARY OF THE INVENTION

A ring binder is described where the ring binder includes a pair of linearly-extending spines, normally of metal material. An inward proximal portion of each of a series of ring elements is attached to respective ones of the spines. The pair of spines are longitudinally hinged together permitting the spines to angularly move to a greater included angle with respect to each other upon finger release of a lock lever at one end of the spines. The "included angle" as used herein means that angle of the two hinged spines as seen looking down at the binder rings. The angular surfaces forming that "included angle" are also termed herein as to top side of the spines. The bottom side of the spines is not seen when the spines have been attached to the binder covers, more particularly to the fabric, board or plastic backbone of the ring binder. The spines are then easily moved back to the original included angle by action of the lock lever and then re-locked at that moved back position.

Preferably the opening operation is assisted by a spring-assist where one or more springs force the rings to an open position automatically upon finger-release of the lock. The lock preferably is a lock mechanism having a push-pull lever extending from one end of the spine which is connected to a pair of pivoted links. The links are connected to inboard ends of rods extending along an outside edge of the spines. A hinge connection, preferably a piano hinge, extends longitudinally between facing edges of the spines with the optional spring-assist cooperating with and positioned contiguously with the hinge. A U-shaped bridge member or pair of bridge members is connected between the spines and are designed to guide the lever and to accommodate relative angular movement of the spines. The bridge members are used further to attach the ring binder unit to a portion of an overall binder, particularly the backbone extending between the front and back binder covers. The overall ring binder unit, more particularly the bridge members, may be rivet-mounted to the binder backbone and the covers. The rings may comprise two substantial half rings essentially forming with the overall spine a substantial circle for reception of hole punched-paper sheets or a matched nearly half-circle portion and a shallow U-shaped portion, together forming a D-shaped ring in a closed position. The term "substantially half-rings" means any ring segments which are used in ring binders.

A ring binder is provided including a linearly-extending first spine, a linearly-extending second spine, a series of spaced first substantially half-rings attached to one of the spines, and a series of spaced second substantially half-rings on the other of the spines, the distal ends of the half-rings on the first spine facing the distal end of the half-rings on the second spine. A hinge connection extends between the spines. A releasable lock including a push-pull lever extends from at least one end of the spines to a pivot connection interiorly of the spines. Movement of the lever is guided by a bridge member and a pair of links are pivoted to the distal end of the lever. The opposite ends of the links are pivoted to a respective one of the spines, particularly to a swaged portion of a rod within a rolled edge of the spines or to a connecting tab including a looped end into which an unswaged rod is inserted. The lock in a locking mode holds the first and second half-rings closed in a paper sheets-holding mode and in a non-locking mode permits opening of the first and second half-rings in a paper sheets removal mode.

BRIEF DESCRIPTION OF THE DRAWINGS

FIG. 17 is a perspective partial view of a third embodiment of the ring binder unit.

FIG. 18 is an exploded view of the lock mechanism thereof.

DETAILED DESCRIPTION

Figure 1:
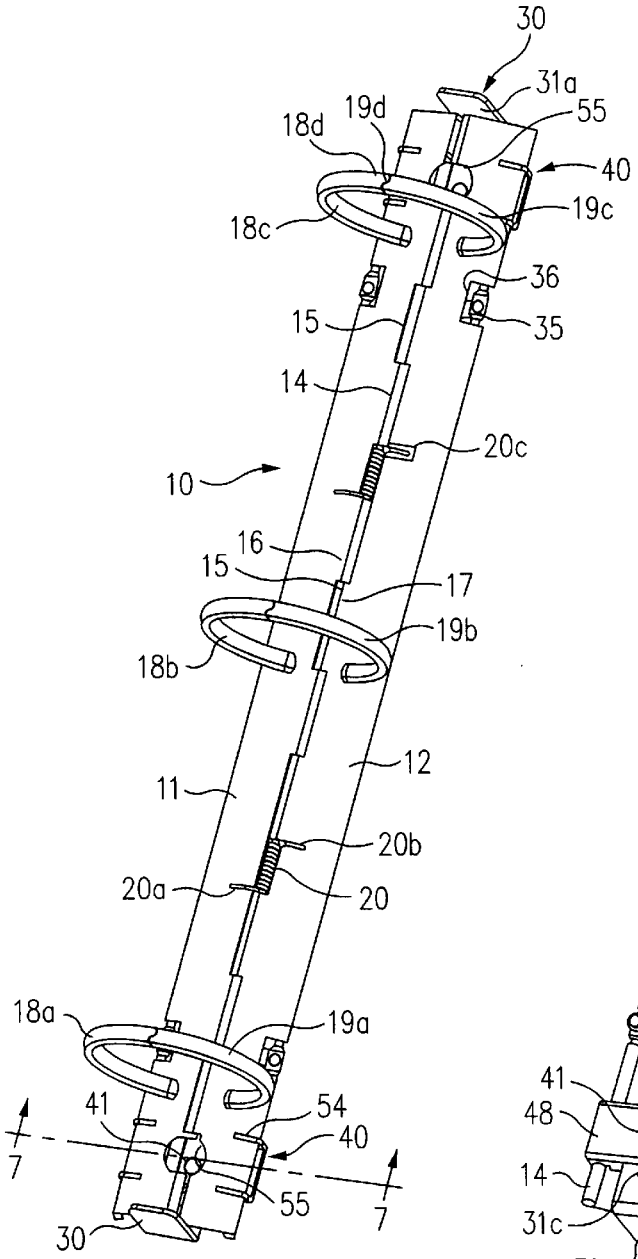
FIG. 1 is a perspective top side view of the ring binder unit in a binder closed mode of operation.

FIG. 1 illustrates the ring binder unit 10 of the invention where a pair of linearly-ending spines 11 and 12 are hinged together by a hinge 14. In a preferred embodiment the hinge 14 is a piano hinge including a central pintle 15 and interfitting edge portions 16 and 17. A series of spaced binder half-rings or ring segments 18*a*, 18*b* and 18*c* (in the case of a three-ring binder) extend from and are fixedly connected to spine 11. A similar set or series of spaced binder half-rings or ring segments 19*a*, 19*b* and 19*c* extend from and are fixedly connected to spine 12. The distal ends 18*d* and 19*d* of the series of half-rings have interdigitated end surfaces forming an S-shaped abutting joint, as is common in binder rings.

Figure 2:
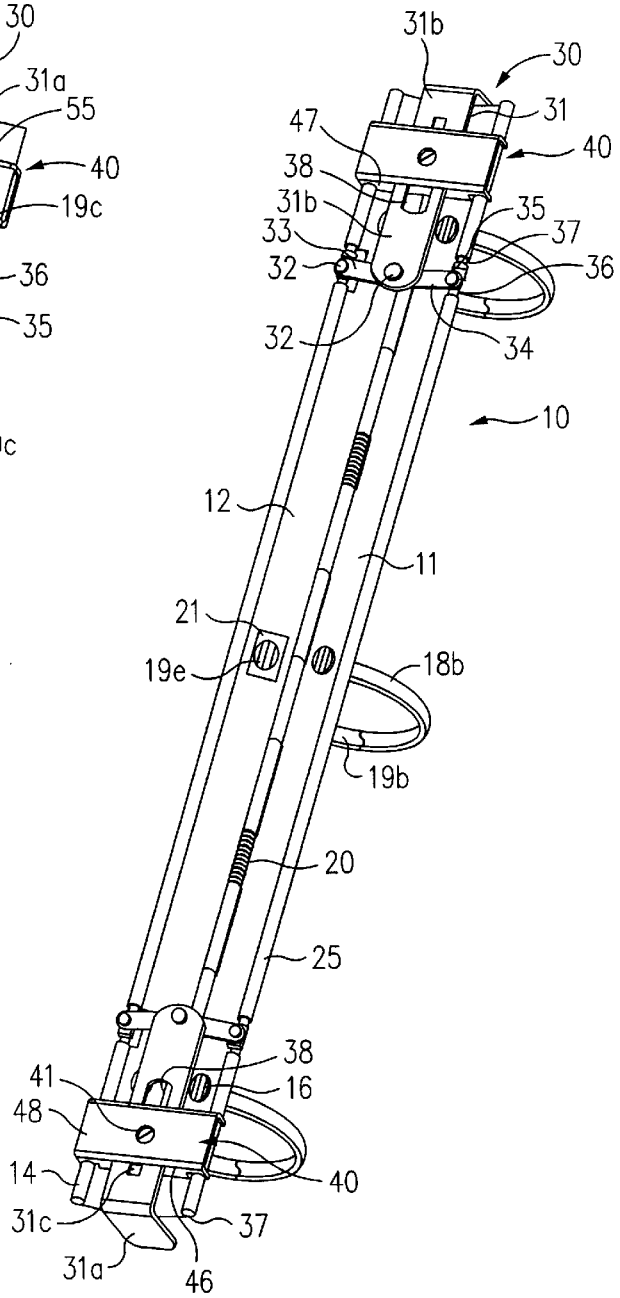
FIG. 2 is a perspective bottom side view thereof.

The rings may be in a welded connection to exterior and interior surfaces of the spines at the proximal ends of the rings. In a preferred embodiment the proximal ends of the ring are staked to the spine by having those ends extend through spaced apertures in the spine and the ends deformed by an upsetting or swaging operation. Rectangular back-up plates 21 (one shown in FIG. 2) may abut the inside of the spines under the upset ring ends 19*e*.

At least one spring 20 (two springs being shown) is associated with the hinge connection of the spines. Preferably the hinge is a piano hinge with the coil portion of a coil spring surrounding a contiguous portion of the linear pintle 15 of the hinge with bent ends 20*a*, 20*b* of the springs transversely abutting the exterior surfaces of both the spines. The spines may include shallow grooves 20*c* (one groove shown) having a depth of about 1 mm and a length of about 10 mm for preventing lateral movement of the spring and to avoid the then-captured spring distal ends of the bend ends 20*a*, 20*b* from scratching a user or providing a paper-sheet tearing edge.

A releasable lock 30 is provided on at least one end of the binder spine unit 10. The lock 30 best seen in FIG. 2, preferably is an L-shaped lever 31 of steel material which includes a substantially rectangular tab 31*a* and an integral slide 31*b*. A pair of steel bridge members 40 guide the slide 31*b* in an in-and-out movement relative to the bridge members. A pair of steel links 33 and 34 are pivoted about pivot pin 32 to the distal end of the lever 31. Opposite ends of the links 33 and 34 are pivotally attached to steel spine rods 37, positioned in inwardly rolled edges 25 of the spines 11 and 12, the rods 37 preferably extending within the rolled spine exterior longitudinal edges 25, best seen in FIG. 7. Each of rods 37 includes a pinched or swaged portion 35 (FIG. 5) positioned in cut-outs 36 in the rolled edges 25 and inboard of the bridge members 40. The links are pivotally attached to portions 35 by other pivot pins 32. Other materials of construction for the lever, the bridge member and the links, such as a plastic, copper or an aluminum alloy may be employed.

Each bridge member includes a rivet hole 41 which is used to make a rivet connection (FIG. 7) with a binder backbone. A slot 38 in the L-shaped lever 31 allows the lever 31 to move in-and-out through the bridge member without touching the rivet in hole 41. The bridge members fit into slots 54 in the spines 11 and 12.

Figure 6:
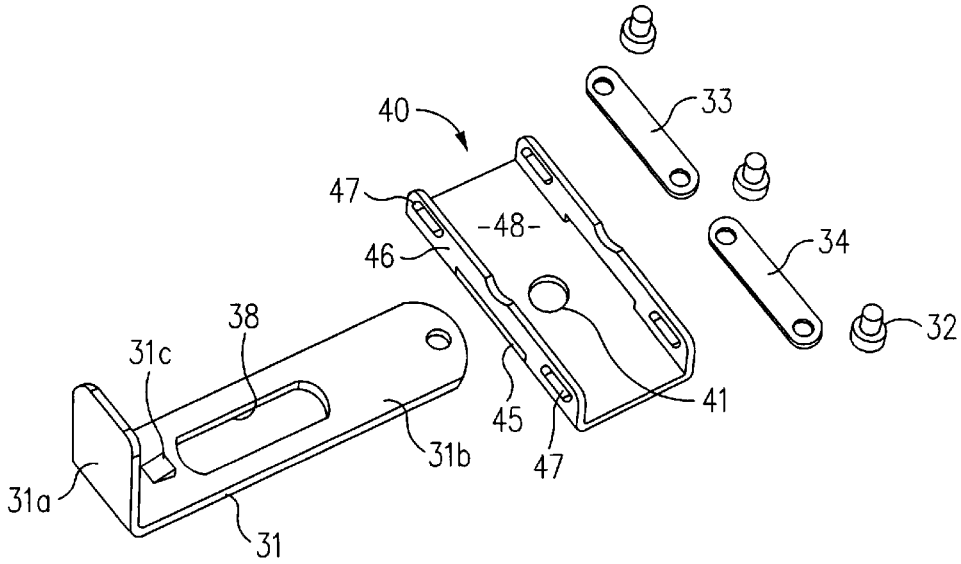
FIG. 6 is an exploded view of one lock mechanism per se.
Figures 8A, 8B, 8C:
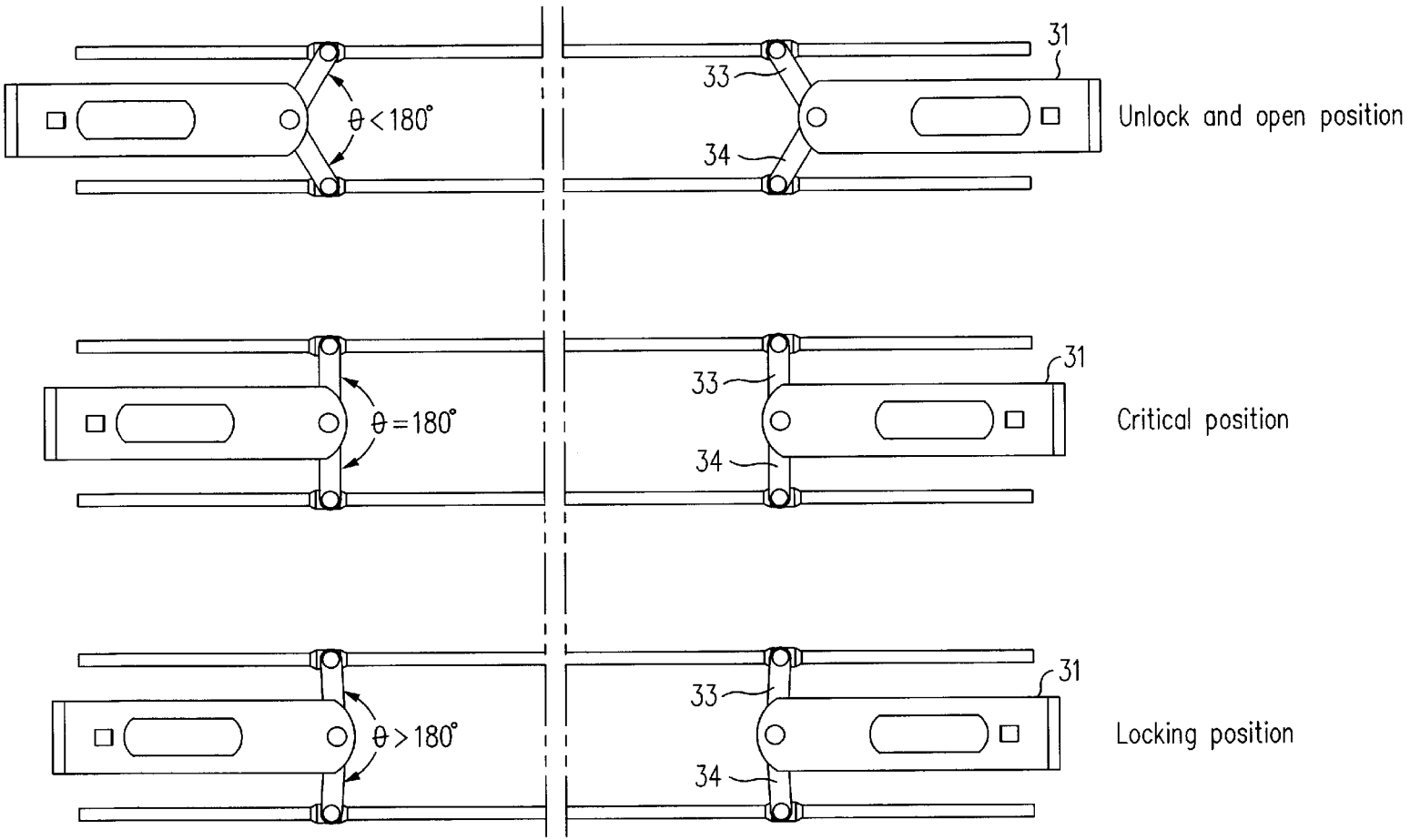
FIG. 8A is a schematic bottom view of the dual locking mechanism in an unlock rings-open position.
FIG. 8B is a schematic bottom view thereof in a critical intermediate position.
FIG. 8C is a schematic bottom view thereof in a locking position.
Figure 9:
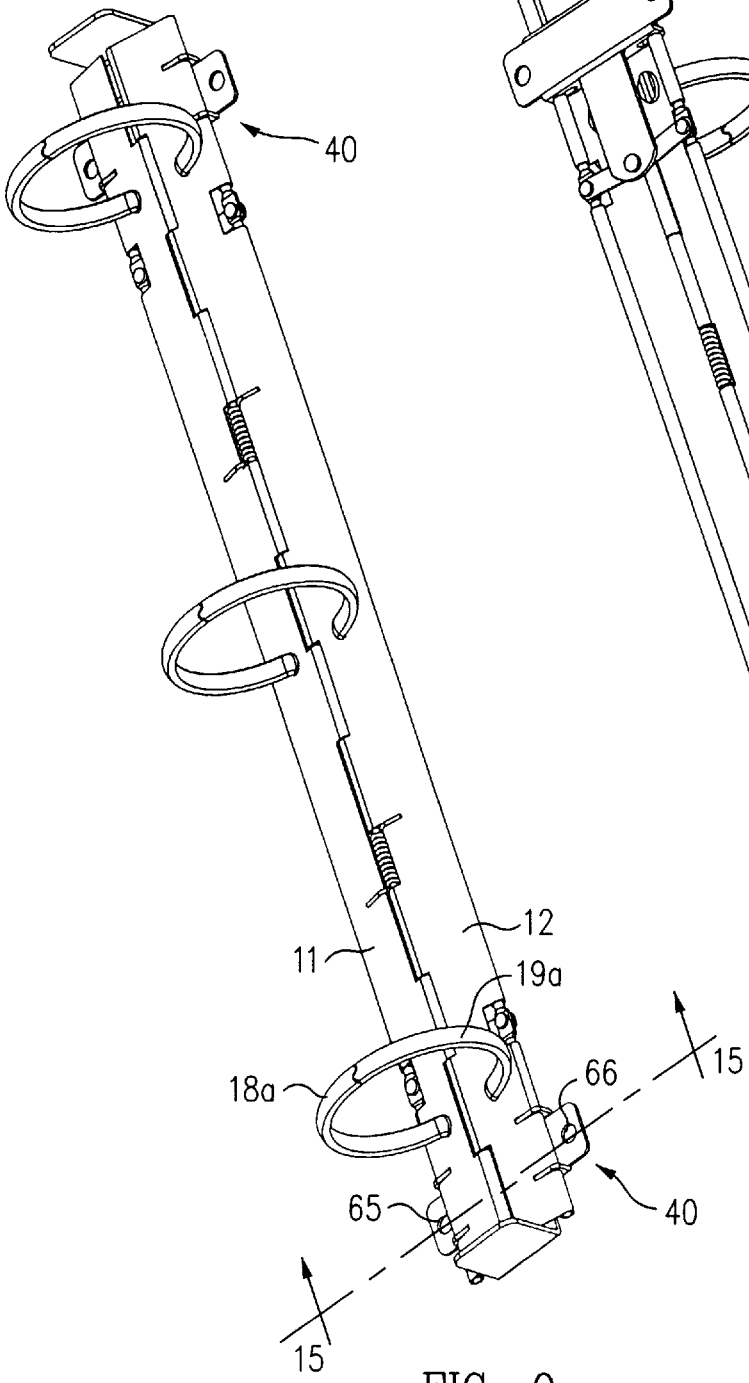
FIG. 9 is a perspective top view of a second embodiment of the invention including a spring-hinge and a dual backbone connection in a rings closed condition.
Figure 10:
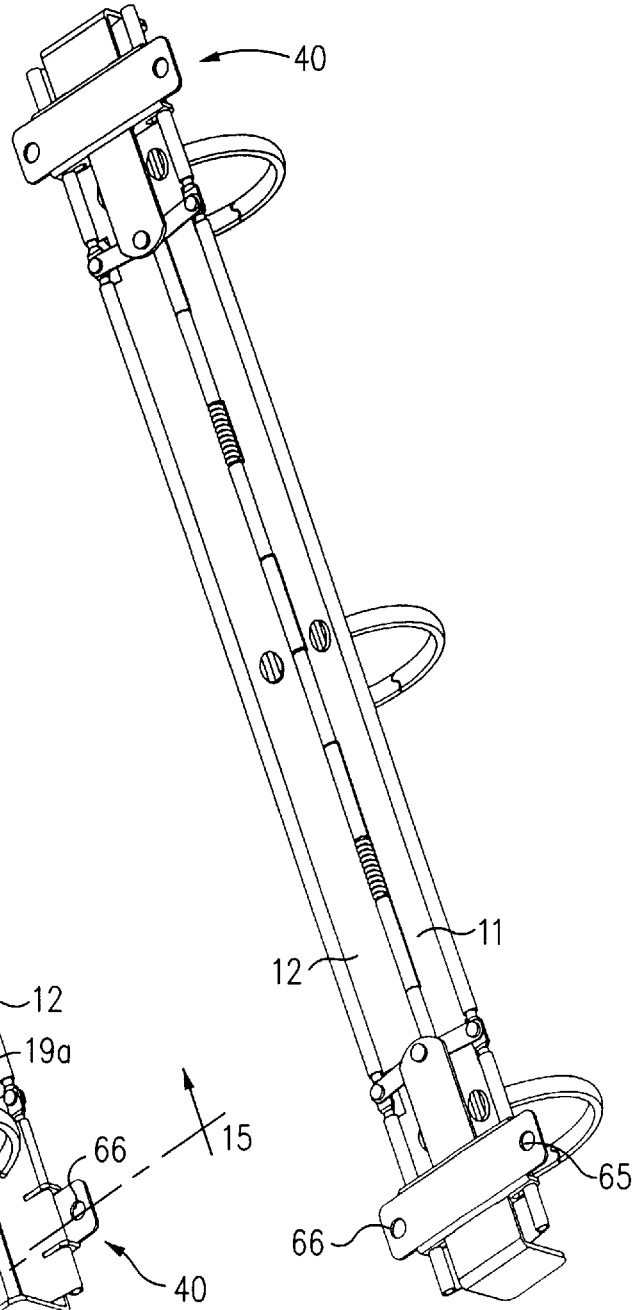
FIG. 10 is a perspective bottom view thereof.
Figure 11:
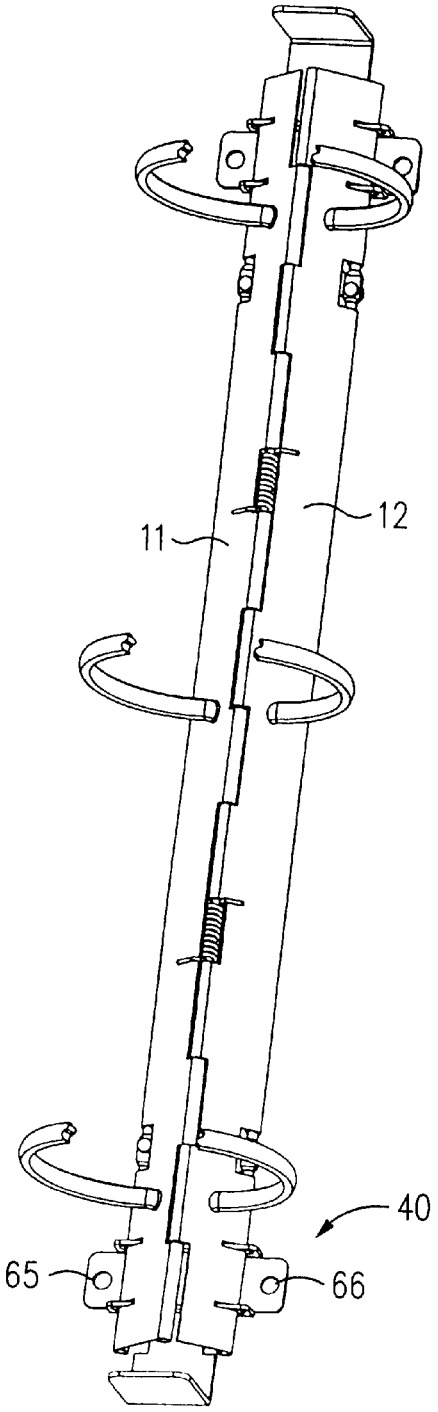
FIG. 11 is a perspective top view thereof in a rings open condition.
Figure 12:
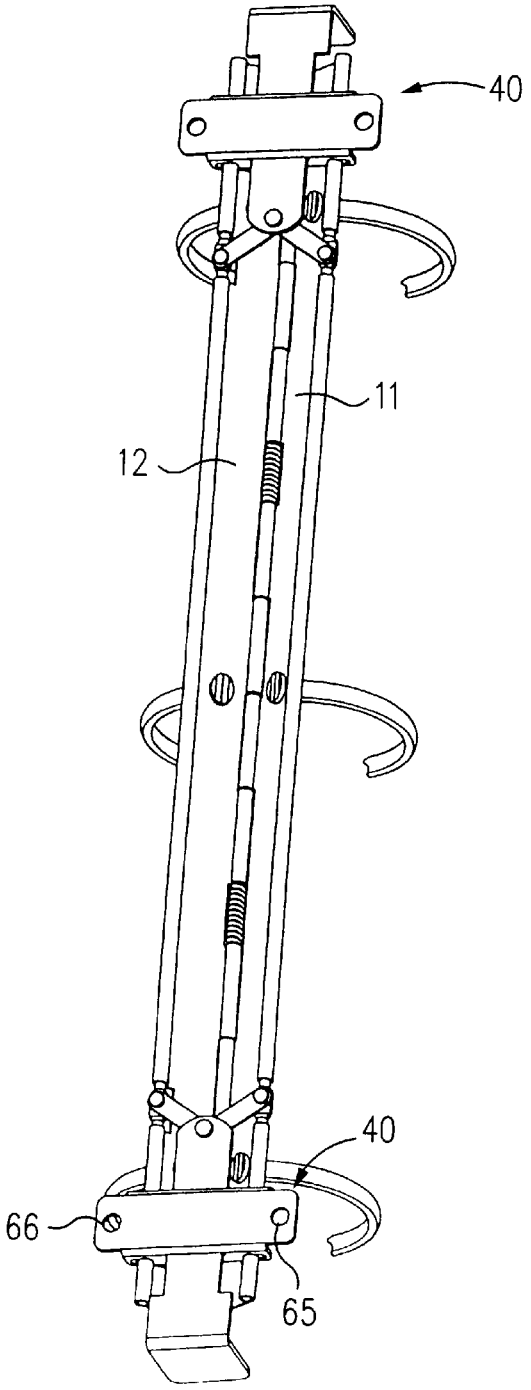
FIG. 12 is a perspective bottom view thereof.
Figure 13:
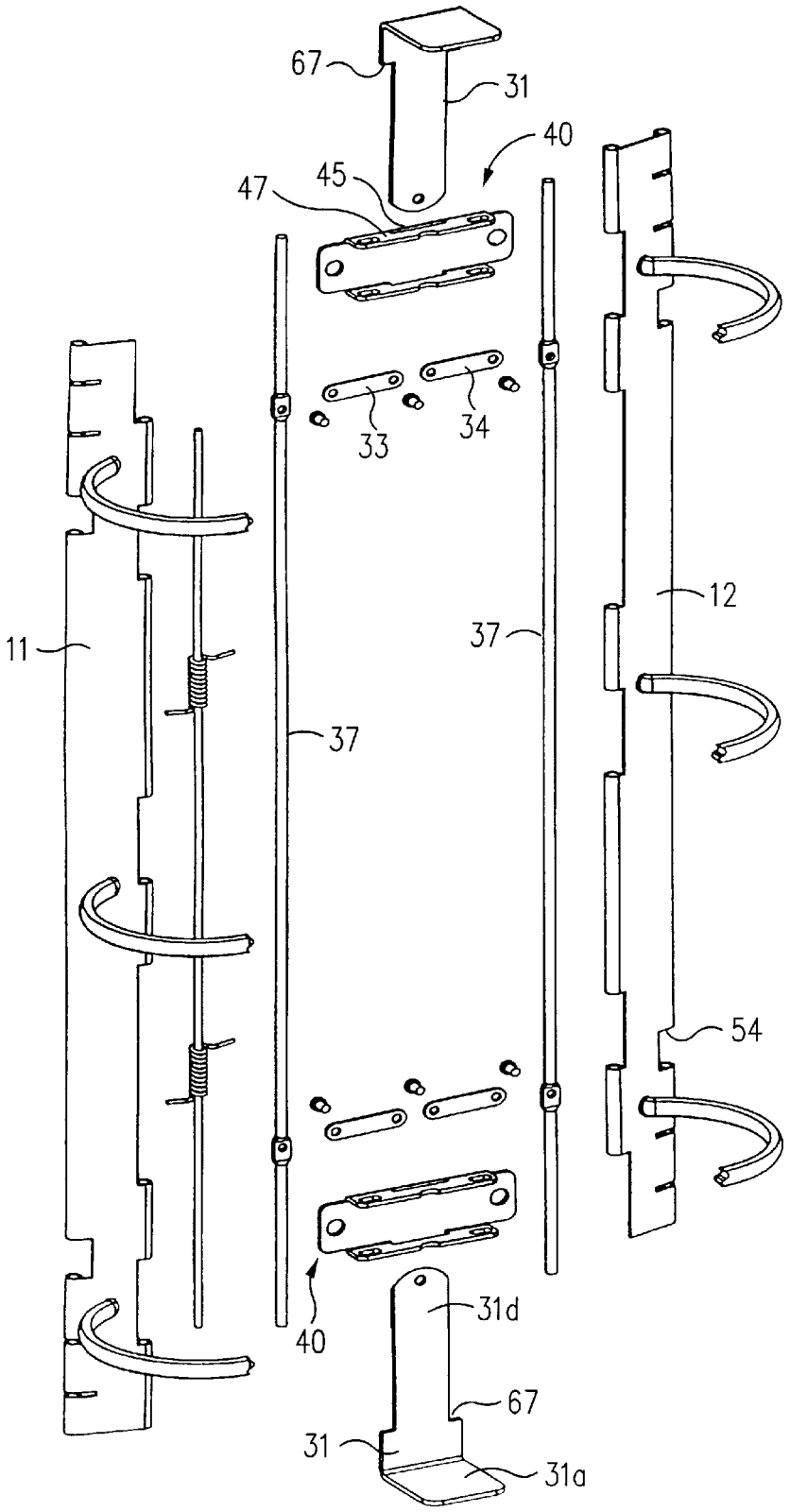
FIG. 13 is an exploded view thereof.

In a rings-closed, hole-punched paper sheets holding mode, the lever has been moved inwardly with respect to the bridge member 40 and is placed by slight finger pressure into a lock position (FIG. 8C). A stopper 31*c* which in the lock position abuts an exterior side edge 46 above slot 45 in the U-shaped bridge member 40, limits inward movement of lever 31. The stopper 31*c* may be in the form of a raised cut-out in the surface of slide 31*b* as best seen in FIG. 6.

The links 33 and 34 are movable by the in-and-out motion of slide 31*b* of lever 31 as a user pushes or pulls the integral tab 31*a* to lock or unlock the rings. When the lever 31 is pulled out relative to the spines 11 and 12 the links 33 and 34 are at an angle to each other of less than 180° and are thus in an unlocked and rings-open position (FIG. 8A). When the lever is then pushed inwardly it passes through a critical position (FIG. 8B) where the angle between the links is 180° then to a locking position (FIG. 8C) where the links are at an angle to each other greater than 180°. A firm pull-out of lever 31, preferably at both ends of the spines 11 and 12 quickly places the links back to an angle less than 180° which allows opening of the rings with or without assistance from the hinge springs 20. The locking action in FIG. 8C holds spine 11 in fixed angular relationship with spine 12.

Figure 3:
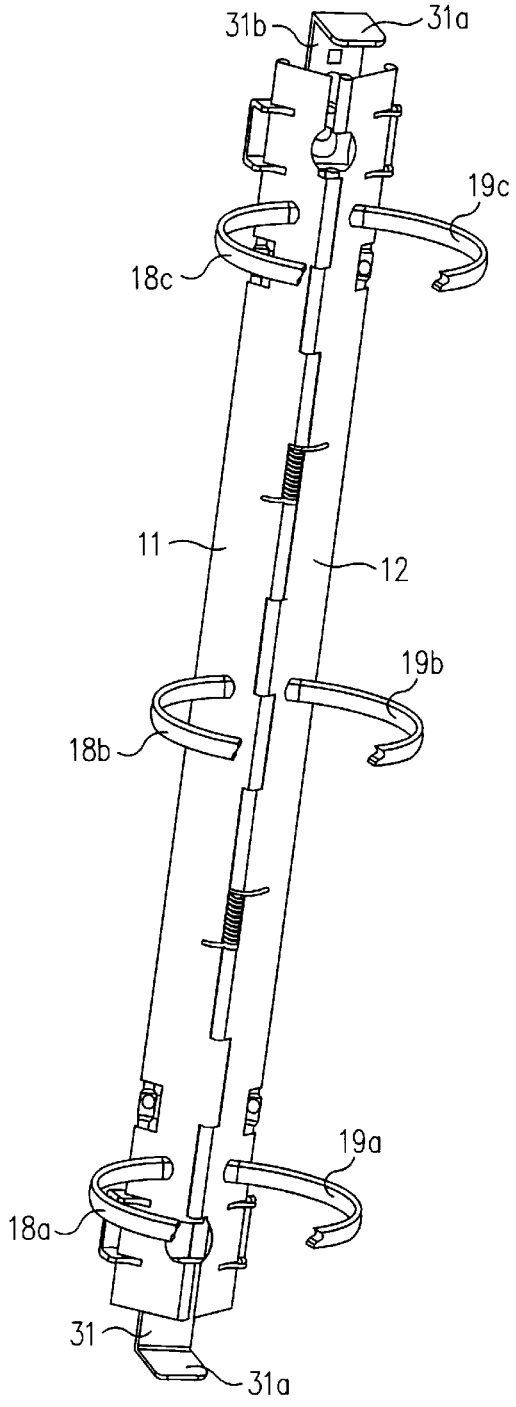
FIG. 3 is a perspective top side view thereof in a rings open mode of operation.
Figure 4:
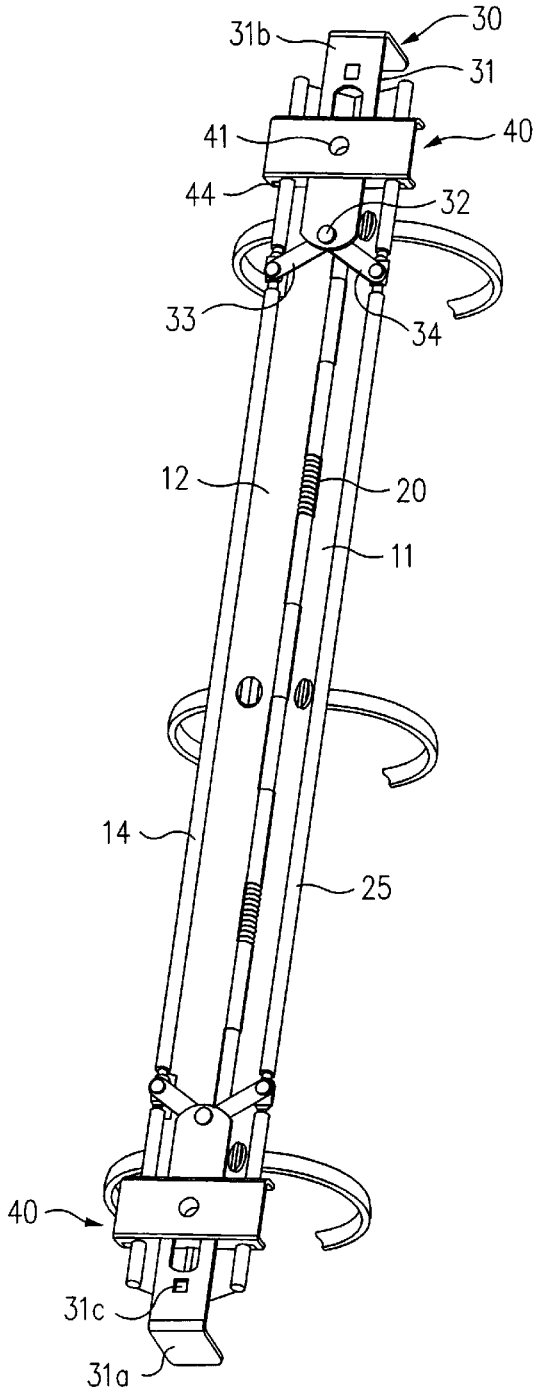
FIG. 4 is a perspective bottom side view thereof in the rings open mode of operation.

The rings open mode is seen in FIGS. 3 and 4 with lever 31 having been pulled into the out position with the links 33 and 34 being in the angularity shown in FIG. 8A. Stopper 31*c* is no longer abutting bridge member 40.

Figure 5:
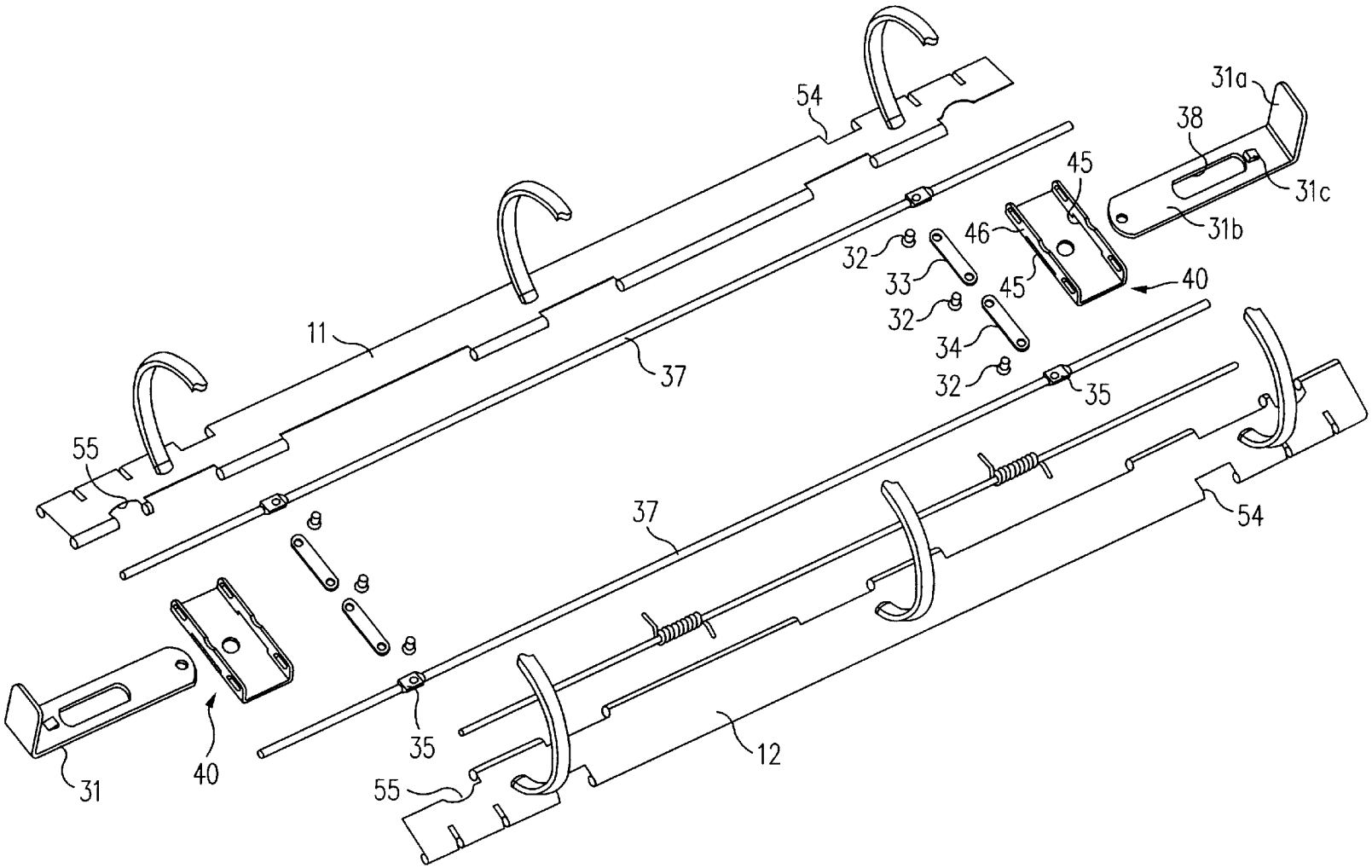
FIG. 5 is an exploded view of the ring binder unit.

FIG. 5 is an exploded view of parts of the ring binder. Particularly best shown are the swaged rod portions 35 and the slide guide slots 45 in the sidewalls 46 of the U-shaped bridge members 40. The guide slots 45 are also seen in FIG. 6 along with other side wall slots 47 through which rods 37 and the rolled outer edges of the spines pass. The slots 47 permit lateral inward movement (arrows 49) of the rods (FIG. 7) during the opening of the rings by the pulling of the levers 31.

Figure 7:
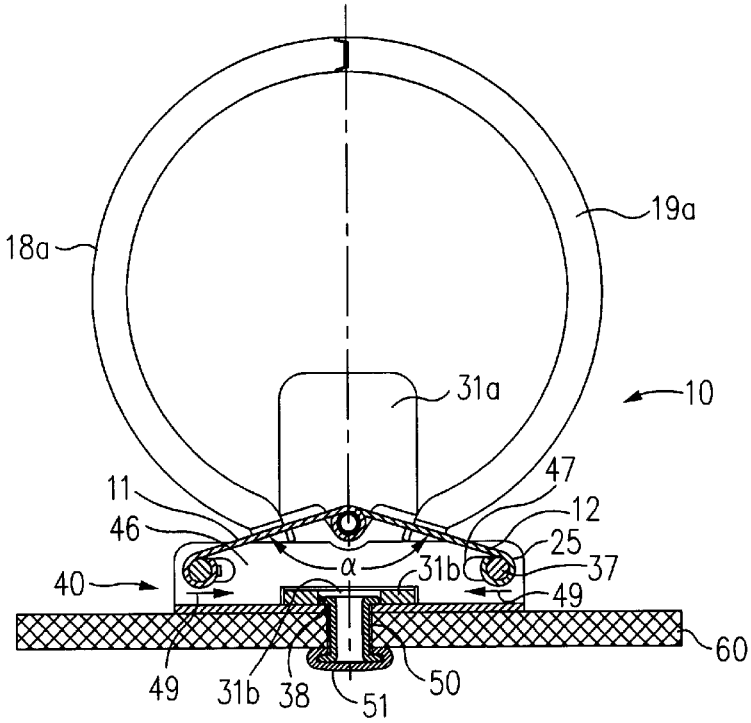
FIG. 7 is a cross-sectional view thereof taken on line 7—7 of FIG. 1 showing the lock in a locking mode and a bridge member attached to a binder cover backbone.

FIG. 7 also illustrates the connection of the binder unit 10 to a backbone 60 of a binder cover (not shown.) A rivet is passed through the bridge member 40, the head of the rivet being in the slot 38 of the lever 31 and not interfering with the slide 31*b* of the lever 31. The rivet is then upset and fastened by swaging the rivet end 51. The included angle a in FIG. 7 in the paper sheets holding mode is from about 145° to 155° while in the sheets removal mode (rings open) the included angle $\alpha$ becomes from about 100° to about 110°.

Figure 14:
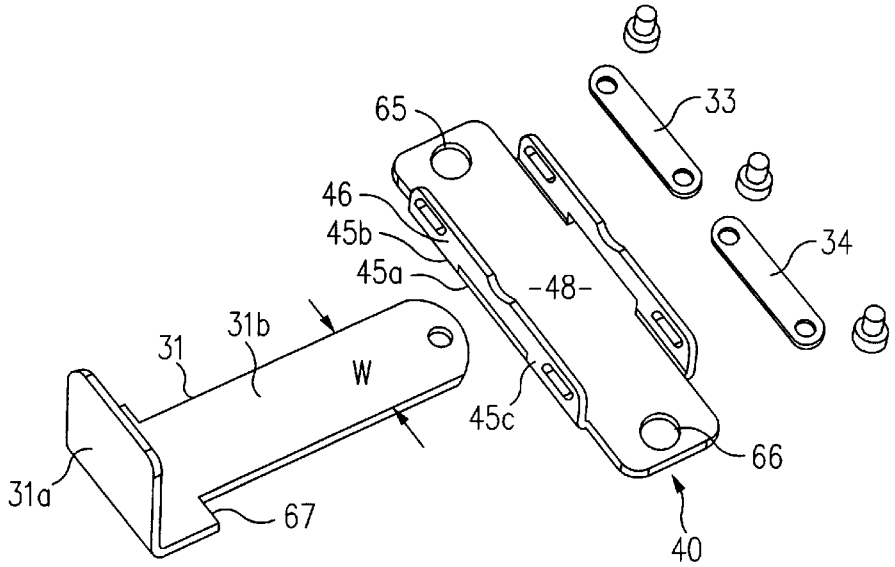
FIG. 14 is an exploded view of a second locking mechanism.
Figure 15:
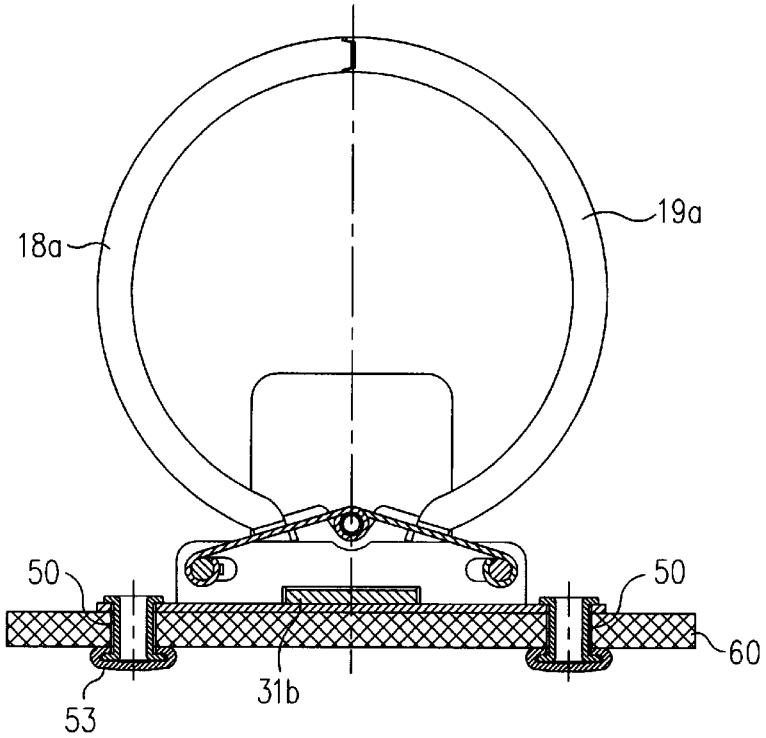
FIG. 15 is a cross-sectional view thereof taken on the line 15—15 of FIG. 9 also showing an attachment to a binder backbone.
Figures 16A, 16B, 16C:
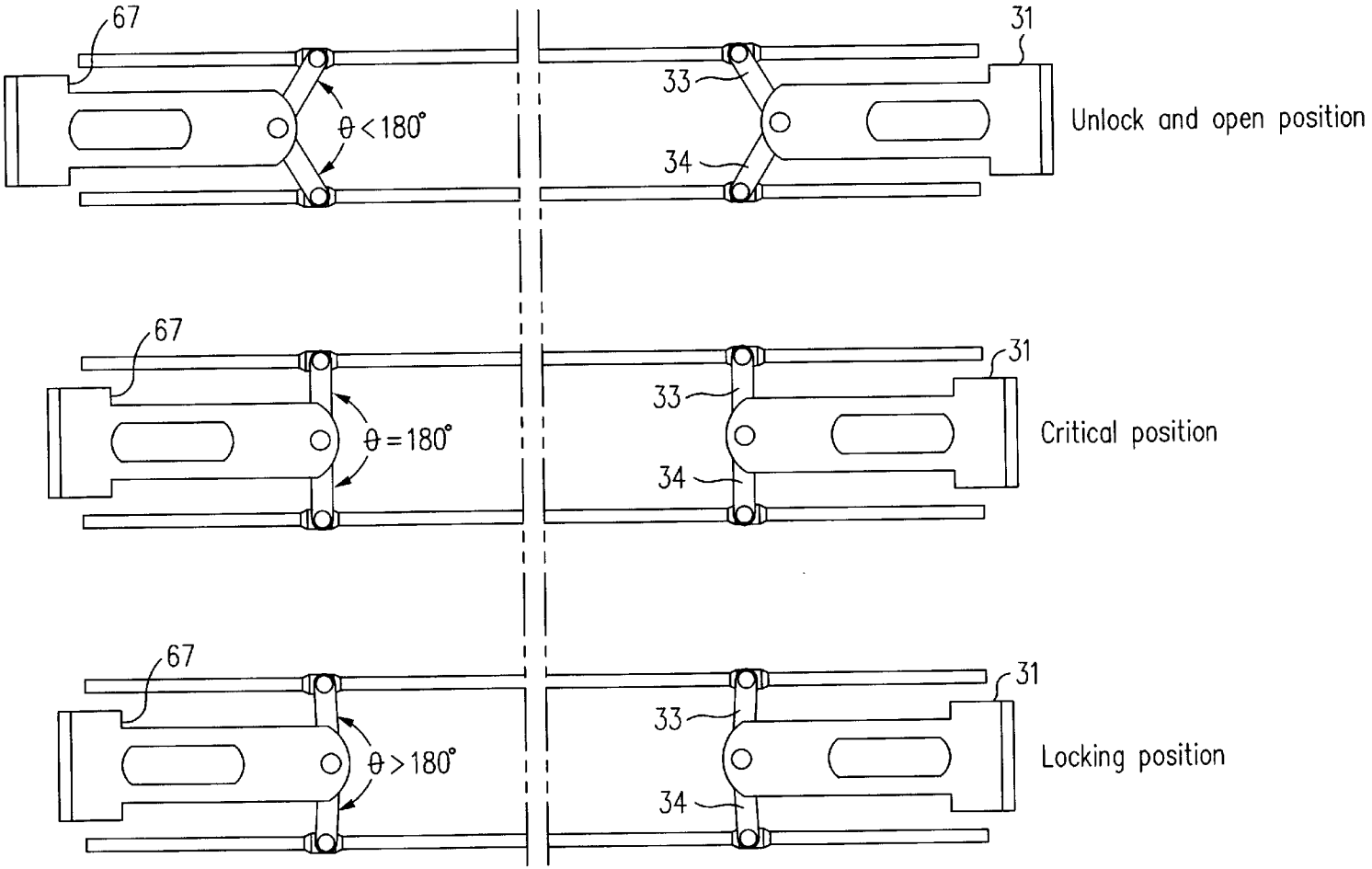
FIG. 16A is a schematic bottom view of the dual locking mechanisms of the second embodiment in an unlock rings-open position.
FIG. 16B is a schematic bottom view thereof in a critical intermediate position.
FIG. 16C is a schematic bottom view thereof in a locking position.

FIGS. 9–16 illustrate a second embodiment of the invention as briefly described above. These views are the same in seriatim as FIGS. 1–8 except for the detail of the bridge members. In FIGS. 9–16 the bridge member contains two rivet holes 65 and 66 at the ends of base 48 and a different stopper is employed. The stopper is in the form of a reentrant edge 67 cut out by narrowing the width of the lever slide portion 31*b* to a width W such that portion 31*b* passes through a narrowed slot 45*a* and when the lever reaches the locking positions shown in FIG. 16C the reentrant edge 67 abuts the outer surface of the side wall 46 transversely adjacent to the slot 45*a* at 45*b* and 45*c* to stop further inward motion of the lever. This is best shown in FIG. 14. FIG. 15 further illustrates the use of two rivets 50 to affix each of the bridge members 40 to a binder cover backbone 60.

The swaged portion 53 of rivets 50 may be covered by a fabric or plastic sheet (not shown) for aesthetic purposes. The bridge member 40 is inserted between the cut-outs 54 in the spine 11 and 12. Cut-outs 55 (FIGS. 1 and 5) in the spines provide an access opening for a rivet driver, when an assembler is deforming the eyelet or rivet 50 to fix the base or bight portion 48 of the U-shaped bridge member to the binder 45.

FIG. 17 illustrates a third embodiment of the locking mechanism where only one end of the binder unit is shown. Particularly the connection of links 33 and 34 to the rods 37 within the rolled edges 25 of spines 11 and 12 has been modified. A cut-out 54 is provided in the spines 11 and 12 at the same location as the swaged portions 35 of rods 37. However, in place of the swaged portions the rods are unswaged and a connecting tab 39 having a looped end 39*a* and a distal end 39*b* is provided. The looped end 39*a* is placed in cut-out 54 and an unswaged longitudinal rod 37*a* is guided through the tab loop ends 39*a* at the respective end portions of each of spines 11 and 12. The flat integral distal ends 39*b* bisects the looped ends and include central apertures 39*c*. Pivot pins 32 are placed into apertures 39*c* and pivotable secure the outboard ends of links 33 and 34. The links, as in the other embodiments are moved by the lever 31 so that the connecting tabs 39, rods 37*a*, the rolled spine edges 25 and the spines 11 and 12 move in slots 47 of the bridge members, so as to close and open the rings in the same manner as illustrated in FIGS. 1–2 and FIGS. 3–4, respectively.

The above description of embodiments of this invention is intended to be illustrative and not limiting. Other embodiments of this invention will be obvious to those skilled in the art in view of the above disclosure.

I claim:

1. A ring binder comprising:

a linearly-extending first spine;

a linearly-extending second spine;

a series of spaced first substantially half-rings attached to one of said spines, and a series of spaced second substantially half-rings on the other of said spines, the distal ends of said half-rings on the first spine facing the distal ends of said half-rings on the second spine;

a hinge connection extending between the spines; and a releasable lock extending from at least one end of said spines, said lock including:

a manually accessible push-pull lever;

at least one bridge member extending between longitudinal outer edges of the respective spines, said lever being guided by the bridge member along a longitudinal axis of the lever parallel to a longitudinal axis of the spines; and a pair of links each pivotally coupled at a proximal end to said lever and each pivotally coupled at a distal end to a respective one of said spines, such that inward movement of the lever toward the respective end of the spines holds said first and second half-rings closed in a sheets-holding mode and outward movement of the lever away from the respective end of the spines permits opening of said first and second half-rings in a sheets-removal mode.

2. The ring binder of claim 1 wherein the first and second spines are co-extensive in length.

3. The ring binder of claim 2 wherein a base portion of each of said half-rings is fixedly connected to an exterior surface of a respective one of the spines.

4. The ring binder of claim 1 wherein the hinge connection is a piano hinge extending between facing longitudinal edges of said first spine and said second spine.

5. The ring binder of claim 4 further including at least one spring associated with said hinge connection, said at least one spring acting to assist in the opening of the half-rings.

6. The ring binder of claim 1 wherein the longitudinal outer edge of each of said spines is a rolled edge, and further comprising a pair of longitudinal rods, each longitudinal rod received in the rolled longitudinal outer edge of the respective spine, the distal ends of the links being pivotally coupled to respective ones of said rods.

7. The ring binder of claim 1 wherein the first and second spines have an included angle of from about 145° to about 155° in the sheets-holding mode and an included angle of from about 100° to about 110° in the sheets-removal mode.

8. The ring binder of claim 1 further including a pair of spaced bridge members extending transversely between longitudinal outer edges of each of said spines, and connecting the spines as a unit to a binder cover element.

9. The ring binder of claim 8 wherein the bridge members each include a slot and wherein each longitudinal outer edge includes a longitudinal rod held on the spines by a rolled spine longitudinal edge, one of said rods and said outer edges being movable in the slot to compensate for an angular movement of the spines from and to the removal mode.

10. The ring binder of claim 8 wherein the bridge members include at least one rivet hole for a rivet connection to a binder cover element.

11. The ring binder of claim 10 where the bridge member is U-shaped and the at least one rivet hole is one hole located centrally in an intermediate bight position of the bridge member, said lever including a central slot for allowing movement of the lever relative to a rivet inserted in the rivet hole.

12. The ring binder of claim 10 wherein each bridge member includes a pair of spaced rivet holes for rivet connections to a binder cover element.

13. The ring binder of claim 1 wherein the lever includes a mechanical stop restricting inward movement of the lever.

14. The ring binder of claim 13 wherein the mechanical stop is a raised cut-out in a top surface of the lever.

15. The ring binder of claim 13 wherein the mechanical stop is on a reentrant edge in said lever which is positioned to abut, upon inward movement of the lever, an exterior of a side edge of a guide slot in the bridge member.

16. The ring binder of claim 1 wherein the spines contain cut out portions at an outer longitudinal edge and further comprising connecting tabs in said cut out portions for connecting a longitudinal rod, extending through each of the connecting tabs and through an exterior longitudinal edge of the spines, to the distal end of a respective link.

17. A ring binder comprising a linearly-extending first spine;

a linearly-extending second spine hingedly connected to the first spine;

a series of first substantially half-rings attached to the first spine;

a series of second substantially half-rings attached to the second spine, the distal ends of the second half-rings facing the distal ends of the first half-rings; and a releasable lock extending from at least one end of the spines, the lock including:

a manually accessible push-pull lever;

at least one bridge member extending between longitudinal outer edges of the respective spines, the lever being guided by the bridge member along a longitudinal axis of the lever parallel to a longitudinal axis of the spines; and a pair of links each pivotally coupled at a proximal end to the lever and pivotally coupled at a distal end to a respective one of the spines, such that movement of the lever toward the respective end of the spines holds the first and second half-rings closed in a sheet-holding mode and movement of the lever away from the respective end of the spines permits opening of the first and second half-rings in a sheet-removal mode, the links being movable between the locked, sheet-holding mode, where the links are at an angle greater than 180°, and the open, sheet-removal mode, where the links are at an angle less than 180°.

* * * * *

UNITED STATES PATENT AND TRADEMARK OFFICE

CERTIFICATE OF CORRECTION

PATENT NO. : 6,036,394
DATED : March 14, 2001
INVENTOR(S) : Cheng, Ho Ping

It is certified that error appears in the above-identified patent and that said Letters Patent is hereby corrected as shown below:

On the title page, at the numeral [73], the name of the assignee is changed from "World Wide Stationary Manufacturing Co., Ltd." to — World Wide Stationery Manufacturing Co., Ltd."—.

Signed and Sealed this

Fifth Day of June, 2001

*Attest:*

*Attesting Officer*

Nicholas P. Godici

NICHOLAS P. GODICI

*Acting Director of the United States Patent and Trademark Office*